United States Patent [19]

Tuvell

[11] 3,954,676

[45] May 4, 1976

[54] SULFONATE DETERGENTS

[75] Inventor: Melvin E. Tuvell, Baton Rouge, La.

[73] Assignee: Ethyl Corporation, Richmond, Va.

[22] Filed: Sept. 26, 1973

[21] Appl. No.: 400,723

[52] U.S. Cl. ..... 252/548; 252/555; 252/DIG. 14

[51] Int. Cl.[2] ..... C11D 1/52; C11D 1/14

[58] Field of Search ..... 252/548, 555, DIG. 14

[56] References Cited

UNITED STATES PATENTS

| | | | |
|---|---|---|---|
| 3,257,436 | 6/1966 | Lindner | 252/548 X |
| 3,640,880 | 2/1972 | Martin | 252/555 |
| 3,741,915 | 6/1973 | Paviak | 252/555 |
| 3,808,156 | 4/1974 | Gorsich et al. | 252/548 X |
| 3,808,157 | 4/1974 | Dewitt et al. | 252/555 |
| 3,852,221 | 12/1974 | Bentley | 252/548 |

OTHER PUBLICATIONS

Knaggs, Article in Soap and Chemical Specialties, Dec., 1964, pp. 79–82 and 277.

*Primary Examiner*—Herbert B. Guynn
*Attorney, Agent, or Firm*—Donald L. Johnson; John F. Sieberth; Shelton B. McAnelly

[57] ABSTRACT

An aqueous composition of matter containing sodium alkene sulfonates or sodium hydroxy alkane sulfonates and aliphatic monoethanol amides in an amount sufficient to increase the viscosity thereof.

2 Claims, 1 Drawing Figure

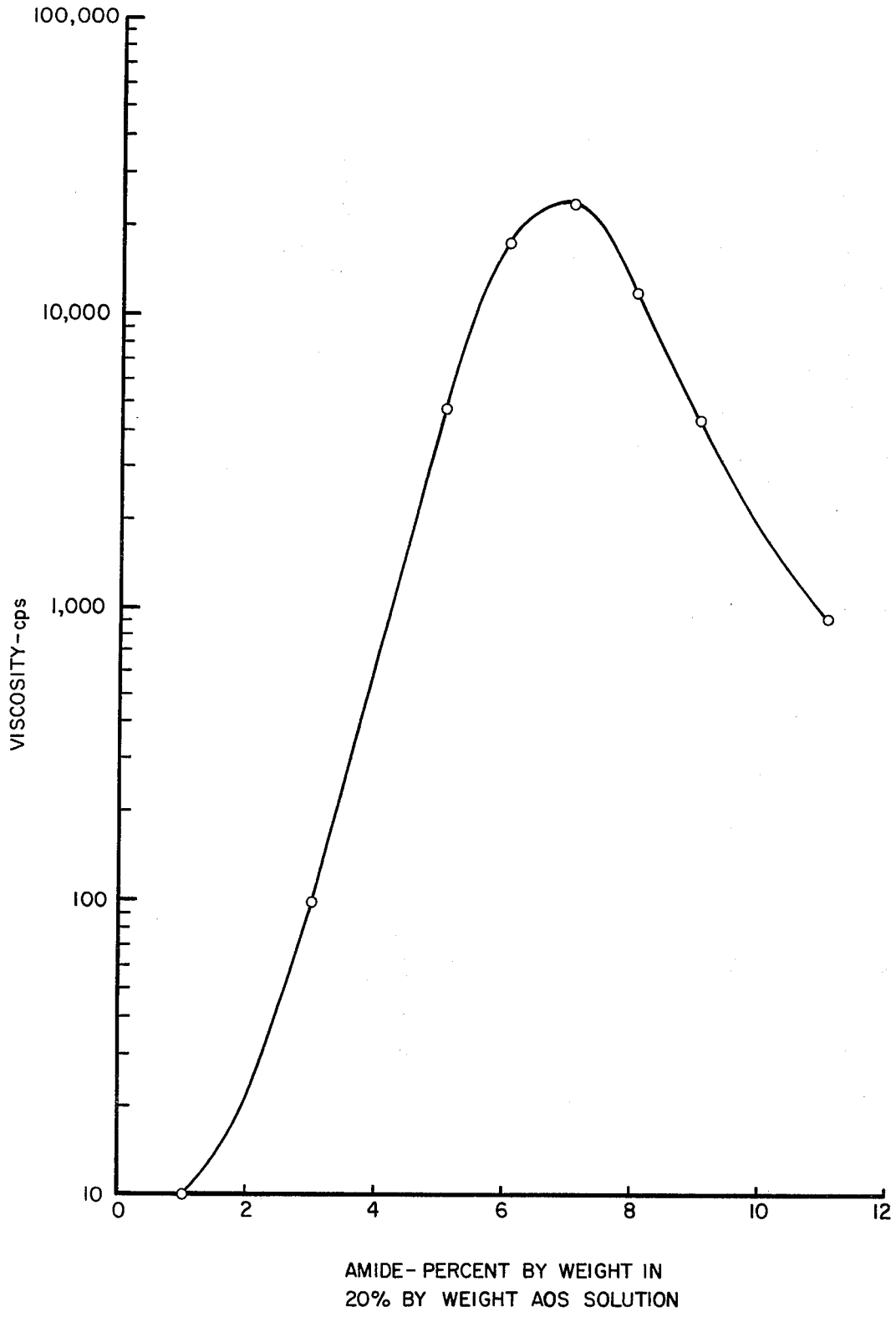
100,000
10,000
1,000
100
10
VISCOSITY-cps
0
2
4
6
8
10
12
AMIDE- PERCENT BY WEIGHT IN
20% BY WEIGHT AOS SOLUTION

SULFONATE DETERGENTS

This invention relates to an aqueous composition of matter containing sodium alkene sulfonates, sodium hydroxy alkane sulfonates or mixtures thereof whose viscosity has been increased by the addition thereto of a selected amount of an aliphatic monoethanol amide such as lauric monoethanol amide, myristic monoethanol amide and the like.

BACKGROUND OF THE INVENTION

As pointed out in U.S. Pat. No. 3,741,915, sodium alkene sulfonates or sodium hydroxy alkane sulfonates, and particularly the mixture of sodium salts of the addition product of $SO_3$ with alpha olefin having from 12 to 18 carbon atoms, are known to possess excellent detergency properties. A convenient form in which these detergents are used is as an aqueous solution thereof, wherein the sodium salt or mixture of sodium salts of the alpha olefin sulfonate (generally referred to in the trade as AOS) amounts to 10 to about 50 percent by weight thereof, preferably from about 20 to about 35 percent by weight thereof. Although the detergency properties of these solutions are excellent they are very fluid. Lacking "body" these solutions are unattractive to consumers because of their watery consistency.

The patent states that additives widely known to improve the viscosity of detergent solutions, such as small amounts of "alkanol amides", were found ineffective for the particular sulfonate composition described therein. In the patent the sulfonate composition is described as follows:

"The sodium sulfonates in the new composition herein can be defined as sodium alkene sulfonates, sodium hydroxy alkane sulfonates or any combination thereof, for example, wherein the weight ratio between the two can be from about 9:1 to about 3:7, preferably from about 1:1 to about 7:3, having from 12 to 18 carbon atoms in the molecule, preferably having from 14 to 16 carbon atoms in the molecule.

"The sodium sulfonates in the new composition herein can be obtained from any source, but, preferably, are obtained by reacting an alpha olefin having from 12 to 18 carbon atoms, preferably from 14 to 16 carbon atoms, with $SO_3$, to obtain a sulfonated addition product thereof, and thereafter the sulfonation product is reacted with sodium hydroxide to obtain a product predominating in the corresponding sodium alkene sulfonates and sodium hydroxy alkane sulfonates having the same number of carbon numbers as the reactant olefin.

"The reaction of the normal alpha olefin with $SO_3$ in the first stage and the subsequent treatment of the sulfonated addition product with sodium hydroxide in the second stage can be carried out in any conventional manner, but in a preferred embodiment are carried out as follows. In the first stage $SO_3$ and an alpha olefin, or a mixture of olefins, for example, dodecene-1, tridecene-1, tetradecene-1, pentadecene-1, hexadecene-1, heptadecene-1 or octadecene-1, wherein the molar ratio of $SO_3$ to said olefin is maintained, for example, within a range of about 0.85 to about 1.15 mols of $SO_3$ per mole of olefin, preferably within a range of about 0.98 to about 1.05 mol of $SO_3$ per mol of olefin. In order to help moderate the temperature within the reaction zone, a temperature regulated thin-film type reactor is employed and the $SO_3$ is introduced therein in admixture with a dry, inert gas, such as nitrogen, air, helium, $SO_2$, $CO_2$, etc. Volume percent of $SO_3$ in the incoming gaseous stream can be maintained within a range of about one to about 20 percent, preferably within a range of about three to about 10 percent. The temperature in the reaction zone can be from about 0° to about 100°C., but preferably from about 20° to about 60°C. The pressure can be, for example, from about atmospheric to about 50 pounds per square inch gauge, preferably from about five to about 15 pounds per square inch gauge.

"The time required for reaction between the olefin and $SO_3$ is difficult to define, since the reaction is exceedingly fast. In practice, the reaction zone is so designed and the flow of reactants therethrough is so adjusted that as soon as reaction between the $SO_3$ and the olefin is effected the sulfonation product resulting from such reaction is removed from the reaction zone. In general, the residence time of the sulfonation product can be, for example, less than about 120 seconds, preferably from about 0.1 to about 60 seconds.

"The sulfonated addition product obtained above can then be cooled to a temperature of about 15° to about 30°C. and the pressure reduced, for example, to about one atmosphere. Inert gases and any unreacted $SO_3$ present are removed from the reaction mixture and can be recycled, if desired, to the first stage of the process. The product is then treated in a hydrolysis step with a molar equivalent of sodium hydroxide, based on the molar amount of $SO_3$ employed, plus from about one to about 10 mol percent excess in sufficient water to yield a final sulfonate solution of from 10 to about 50 percent, at a temperature of about 50° to about 200°C., preferably about 95° to about 175°C., and a pressure of about atmospheric to about 240 pounds per square inch gauge, for a period sufficient for the addition product to be completely neutralized.

"The composition thus obtained can contain (1) from about 20 to about 80 percent by weight, generally from about 30 to about 70 percent by weight, of double bond positional isomers of water-soluble sodium alkene-1 sulfonic acids, including the alpha-beta, beta-gamma and gamma-delta unsaturated isomers thereof; and (2) from about 10 to about 70 percent by weight, generally from about 20 to about 60 percent by weight, of a mixture of water-soluble sodium salts of aliphatic compounds containing hydroxy and sulfonate radicals, with the sulfonate radical being on the terminal carbon and the hydroxyl radical being greater than two carbons away from said terminal carbon atom. There may also be present in an amount that can be from about two to about 20 percent by weight of the composition, but generally in the range of about five to about 15 percent thereof, a mixture of water-soluble sodium salts of alkene disulfonates and water-soluble sodium salts of hydroxy alkane disulfonates. Each of these sulfonates will also carry the same number of carbon atoms as the reactant olefin. Minor amounts of other species resulting from this reaction may also be present."

SUMMARY OF THE INVENTION

This invention, inter alia, involves the discovery that aliphatic monoethanol amides in which the acyl group contains from about 10 to about 14 carbon atoms, such as capric monoethanol amide, lauric monoethanol amide and myristic monoethanol amide are effective for improving the viscosity of aqueous solutions of alpha olefin sulfonate (AOS) when employed therein as an additive. In fact, by employing the monoethanol amide of a mixture of lauric and myristic acids it is possible to achieve in concentrated AOS solutions viscosities of 10,000 cps (centipoises per second) and higher. In view of the finding reported in U.S. Pat. No. 3,741,915 that "alkanol amides" were ineffective to improve AOS viscosity, it is surprising that such aliphatic monoethanol amides have any effectiveness at all, let alone the effectiveness exhibited in the compositions of this invention.

The DRAWING shows the effect on viscosity of a particular AOS solution by the addition thereto of various amounts of a specific amide composition.

DESCRIPTION OF THE INVENTION

Detergent active compositions based on AOS are highly useful materials particularly where body can be imparted thereto to facilitate handling and measurement, in use thereof. In the present invention, extremely high viscosities of 10,000 cps (centipoises per second) and above are obtained with AOS:monoethanol amide weight ratios of from 2.5:1 to 3.67:1. Where the AOS:monoethanol amide weight ratios are from 2.67:1 to 3.33:1, preferred higher viscosities of 20,000 cps and above are obtained. Especially preferred maximum viscosities of about 25,000 cps are obtained when the AOS:monoethanol amide weight ratio is about 2.86:1.

Compositions according to the present invention are solutions wherein the amount of AOS is at least about 8 percent by weight. Preferred compositions have at least about 15 percent AOS by weight while especially preferred compositions have at least about 20 percent AOS by weight. The more concentrated solutions generally have higher viscosity and therefore they are usually preferred where maximum viscosities are desired. Preferred compositions contain at least about 20 percent AOS by weight and have an AOS:amide weight ratio of from 2.67:1 to 3.33:1. Especially preferred compositions contain at least about 20 AOS by weight and have an AOS:amide weight ratio of 2.86:1.

Preferred monoethanol amides used in the compositions of the present invention have from twelve to fourteen carbon atoms in their acyl groups. Such amides have excellent properties. Preferred monoethanol amides are amides of lauric acid and myristic acid, because these are readily obtained from natural source coconut oil.

An excellent preferred monoethanol amide mixture is obtained by reacting the methyl esters of a commercial mixture (70:30) of lauric and myristic acids with monoethanol amine using known processing such as that of U.S. Pat. No. 3,257,436. The weight ratio of lauric monoethanol amide to myristic monoethanol amide in the product from such a reaction using the aforementioned esters derived from natural source materials is about 70:30. This mixture is a preferred amide constituency for compositions of the present invention.

Preferred AOS contained in the compositions of the present invention has 14 to 16 carbon atoms per molecule, especially where the amide is lauric monoethanol amide and myristic monoethanol amide in a weight ratio of about 70:30 and the ratio of AOS:monoethanol amide is from 2.67:1 to 3.33:1. In particularly preferred compositions in accordance with the present invention, the AOS has 14 to 16 carbon atoms per molecule, the monoethanol amide is a mixture of lauric monoethanol amide and myristic monoethanol amide in a ratio of about 70:30, a ratio of AOS:monoethanol amide is about 2.86:1 and the amount of AOS in the solution is at least about 15 percent by weight.

EXAMPLE

A standard solution of AOS in deionized water was prepared using a sodium AOS produced by saponifying with NaOH the product of a reaction of mixed olefins with $SO_2$ in a falling film reactor. The olefins sulfonated were a mixture of $C_{14}$ and $C_{16}$ olefins in a weight ratio of about 2:1. The AOS solution contained 33.9 percent active.

Fifty-nine grams of the standard AOS solution were placed in a 4 ounce bottle, 20 grams of deionized water added. The pH of the solution was adjusted to between 7.2 and 7.5 by adding a solution of 10 percent sulfuric acid. Additional deionized water was added to provide a 93 gram solution containing 20 grams of AOS.

Then 7 grams of lauric-myristic monoethanol amide (70–30) (LMMEA) flake was added and the mixture stirred in a water batch at about 93°C until all the LMMEA dissolved forming a clear solution with an AOS:LMMEA weight ratio of 20:1.

The solution was cooled to 25°C and the viscosity measured with a Rotovisco Viscosimeter.

A similar procedure was used to provide other solutions containing different amounts of AOS and different ratios of AOS and amide.

The FIGURE was prepared using viscosity data taken on solutions containing 20 percent by weight of AOS and various amounts of amide (percent by weight). The FIGURE shows a clearly defined peak of high viscosity of about 25,000 cps at an AOS:amide weight ratio of 2.86:1. Viscosities of 20,000 cps and higher are obtained with an AOS:amide ratio of from 2.67:1 to 3.33:1. Viscosities of 10,000 cps and higher are obtained with an AOS:amide ratio of from 2.5:1 to 3.67:1.

I claim:

1. An aqueous composition of matter consisting essentially of an aqueous solution of alpha olefin sulfonate having 14 to 16 carbon atoms per molecule and monoethanol amide, said solution containing at least about 8 percent by weight of the alpha olefin sulfonate and having an alpha olefin sulfonate:monoethanol amide weight ratio in the range of from 2.67:1 to 3.33:1, said monoethanol amide being a mixture of lauric monoethanol amide and myristic monoethanol amide in a weight ratio of about 70:30.

2. The composition of claim 1 wherein the alpha olefin sulfonate:monoethanol amide weight ratio is about 2.86:1 and said solution contains at least about 15 percent by weight of said alpha olefin sulfonate.

* * * * *